United States Patent [19]

Lam

[11] 4,364,106

[45] Dec. 14, 1982

[54] LIGHT DISPLAY DEVICE WITH TRAVELLING BALLS AND COMPOUND ROTATION

[76] Inventor: Anthony C. Lam, 371 Dalcourt, Quebec, Canada, J7V 6G5

[21] Appl. No.: 229,420

[22] Filed: Jan. 29, 1981

[51] Int. Cl.[3] ..... F21V 21/26

[52] U.S. Cl. ..... 362/272; 362/32; 362/216; 362/275; 362/252; 362/806; 362/361

[58] Field of Search ..... 362/32, 216, 252, 269, 362/272, 275, 361, 806, 808, 809

[56] References Cited

U.S. PATENT DOCUMENTS

| | | | |
|---|---|---|---|
| 2,343,173 | 2/1944 | Dupler | 362/361 X |
| 2,343,598 | 3/1944 | Wagner | 362/361 X |
| 2,433,747 | 12/1947 | Dupler | 362/275 |
| 2,443,510 | 6/1948 | McCallum . | |
| 2,570,778 | 10/1951 | De Vane | 362/428 X |
| 2,721,256 | 10/1955 | Duhon . | |
| 2,806,938 | 9/1957 | Henry | 362/216 X |
| 2,812,421 | 11/1957 | Archer | 362/216 X |
| 3,111,057 | 11/1963 | Cramer . | |
| 3,166,973 | 1/1965 | Healey . | |
| 3,387,782 | 6/1968 | Mizuno | 362/806 X |
| 3,711,698 | 1/1973 | Hess . | |
| 3,760,176 | 9/1973 | Trop . | |
| 4,146,919 | 3/1979 | Jennings | 362/806 X |
| 4,177,503 | 12/1979 | Anguetin | 362/278 X |
| 4,316,120 | 2/1982 | Cotman et al. | 362/216 X |

*Primary Examiner*—Peter A. Nelson

*Attorney, Agent, or Firm*—Norman B. Rainer

[57] ABSTRACT

A rigid assembly of hollow tubes is caused to rotate simultaneously about vertical and horizontal axes while illuminated from below by a stationary light source. Balls confined within the tubes travel within said tubes during the rotational motion.

9 Claims, 5 Drawing Figures

LIGHT DISPLAY DEVICE WITH TRAVELLING BALLS AND COMPOUND ROTATION

BACKGROUND OF THE INVENTION

This invention concerns a display device for producing continuously variable lighting effects, and more particularly relates to a device having a plurality of light conduits arranged in a rigid assembly which undergoes rotation in a manner to produce a continuously variable display of light patterns.

Lighting displays of an unusual, eye-catching nature have long been used in advertising media to attract visual attention. Such lighting displays, especially of continuously variable nature, have also been used to entertain children and provide decorative enhancement of homes and business establishments. The extent of visual appeal of a lighting display is generally highest when the display involves a multitude of light configurations in an ever-changing pattern.

Securement of the aforementioned desirable lighting displays often requires cumbersome or complex mechanisms susceptible to malfunction, especially where the light emitting sources are required to move and thereby require sliding electrical contacts. The use of a multitude of light emitting sources of limited life-expectancy and requiring switching mechanisms increases the probability of malfunction of the device. Certain prior art designs have also required mechanical or electrical features which cannot be safely left unattended for continuous operation.

Accordingly, it is an object of the present invention to provide a device of relatively simple construction capable of producing a continuously variable lighting effect.

It is a further object of this invention to provide a device of the aforesaid nature capable of operating with a single and stationery light emitting source.

It is a still further object of the invention to provide a device as in the foregoing object of an easily portable nature and substantially free of safety hazards.

It is a still further object of this invention to provide a device of the aforementioned nature which provides a multitude of light configurations without requiring electrical switching means or moving electrical contacts.

These objects and other objects and advantages of the invention will be apparent from the following description.

SUMMARY OF THE INVENTION

The above and other beneficial objects and advantages are accomplished in accordance with the present invention by a display device which comprises: (a) a rigid assembly of toroidally shaped hollow tubes which confine balls adapted for continuous travel within said tubes, said assembly having a plane of symmetry perpendicular to said tubes, (b) a pair of diametrically opposed pivot means associated with the outermost tube of said assembly and adapted to permit rotation of said assembly about a horizontal axis, (c) a base which underlies said assembly, (d) support means associated with said base in a manner permitting rotation of said support means about a vertical axis within said plane of symmetry, said support means extending upwardly from said base and engaging said pivot means, (e) energizing means housed within said base, (f) motion coupling means which, when activated by said energizing means, rotate said assembly about said horizontal and vertical axes simultaneously, and (g) a light source associated with said base and adapted to illuminate said tubes substantially uniformly with respect to said vertical axis.

In a preferred embodiment of the invention, the assembly is comprised of a first series of concentrically arranged tubes and a second series of concentrically arranged tubes interspersed in alternating manner between tubes of said first series and perpendicular thereto, all tubes being interconnected to form a rigid assembly.

Said motion coupling means, in a preferred embodiment, comprises: (1) a horizontally disposed circular track associated with said support means, (2) a first drive means propelled by said energizing means and in rotative engagement with said horizontally disposed circular track in a manner to rotate said support means about a vertical axis, (3) a second drive means mechanically communicating with and propelled by said horizontally disposed circular track, and (4) a vertically disposed circular track which circumnavigates said assembly in attachment therewith, and is rotatively engaged by said second drive means in a manner to rotate said assembly about a horizontal axis.

BRIEF DESCRIPTION OF THE DRAWINGS

For a fuller understanding of the nature and objects of the invention, referral should be had to the following detailed description taken in connection with the accompanying drawing forming a part of this specification and in which similar numerals of reference indicate corresponding parts in all the figures of the drawings.

DETAILED DESCRIPTION OF THE PREFERRED EMBODIMENT

Figure 1:
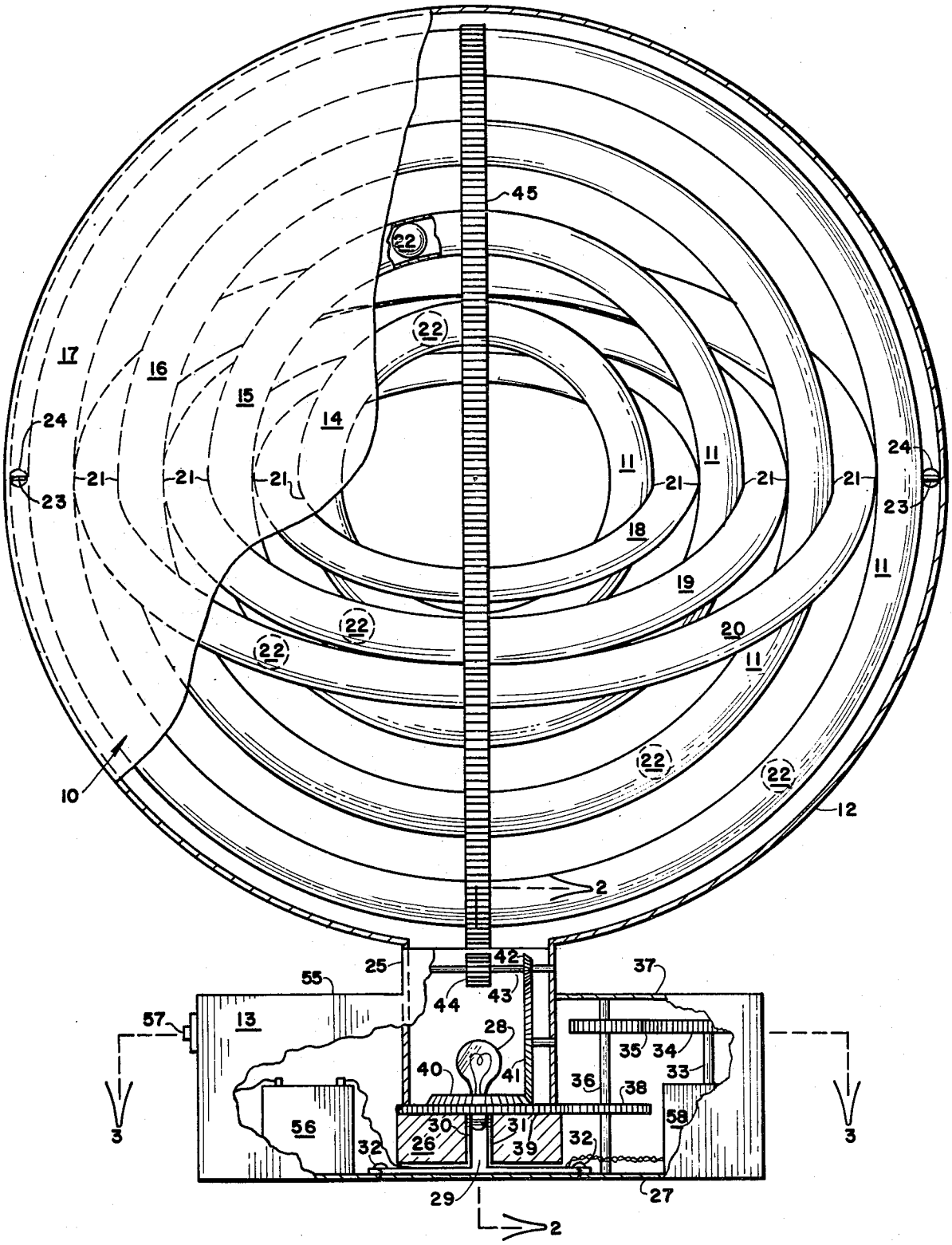
FIG. 1 is a front view of an embodiment of the device of this invention with parts broken away to reveal details of internal structure.
Figure 2:
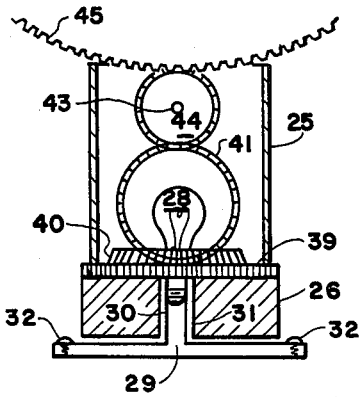
FIG. 2 is a sectional view taken along the line 2—2 of FIG. 1.
Figure 3:
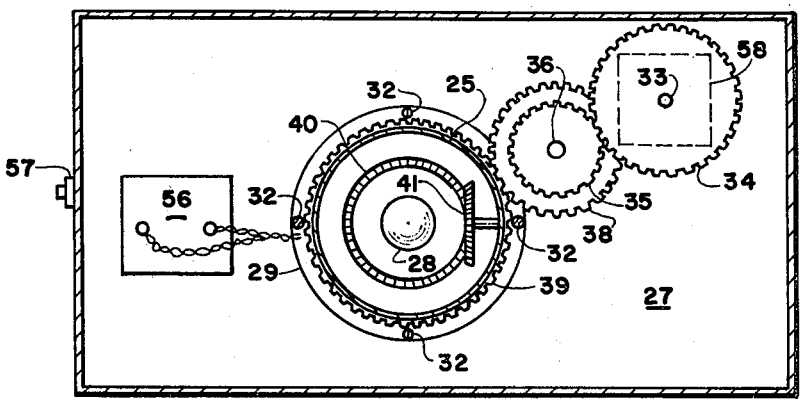
FIG. 3 is a sectional view taken along the line 3—3 of FIG. 1.

Referring to FIGS. 1–3, a device of this invention is shown comprised of an assembly 10 to toroidally shaped tubes 11 enveloped by spherical enclosure support means 12 and positioned above the box-like base 13.

Assembly 10 is comprised of a first series of concentrically arranged tubes designated 14, 15, 16 and 17, and a second series of concentrically arranged tubes designated 18, 19, and 20. The tubes of said first series are interspersed in alternating manner between the tubes of said second series and perpendicular thereto, all tubes being interconnected at contact points 21 to form a rigid assembly. Said contact points, twelve in number for the embodiment of FIG. 1, are arranged in a straight line which passes through the center of assembly 10. The arrangement of said tubes is such as to cause said assembly to have a plane of symmetry which includes the center of said assembly, and perpendicularly bisects the tubes of both series and said line of contact points. Balls 22 are confined within said tubes adapted for continuous unrestricted travel therein.

The tubes have a toroidal shape, preferably the shape of a torus, namely a doughnut-shaped surface generated by a small circle rotated in large circular path in a plane perpendicular to said small circle. The tubes of the same concentric series preferably have the same outside tube diameter, namely the dimension A shown in FIG. 4. Suitable outside tube diameters may range from about 0.5 to 2.0 inches. The diameter of the large toroidal circle, namely the dimension B shown in FIG. 4 may range from about 9 inches to 50 inches. The wall thickness of the tubes may range from about 0.1 to 0.25 inch. The attachment of tubes to adjacent tubes may be secured by bonding agents based upon solvent systems, hot-melt agents or cross-linking compositions.

The tubes are fabricated of rigid material having high optical transmittance properties. Suitable materials include for example glass and polymeric materials such as polymethylmethacrylate, polycarbonate, ionomer resins, polysulfones, acrylonitrile copolymer resins, cellulose butyrate, and polyesters of low crystallinity. The use of thermoplastic embodiments of the aforementioned polymeric materials is preferable because it facilitates fabrication of the tubes by an extrusion operation and subsequent cutting of sections to desired length, bending the sections while heat-softened, and thermally joining the two ends of the bent section.

The material of which said tubes are fabricated may contain incorporated therein pigments, flourescing and phosporescing agents, reflecting moieties and other species capable of interacting with light to produce visibly distinctive effects. Similar light-interactive species may be applied as a coating to the outer and/or inner surfaces of the tubes. The tubes in certain embodiments may be made to confine, in addition to the traveling ball, liquid species which move with movement of the tubes, and said liquid may contain dissolved or dispersed agents which provide novel optical effects. In a still further embodiment, the tubes may be evacuated except for low pressure traces of gases such as neon, helium, argon and krypton capable of emitting light when excited by suitable high frequency electrical current. The balls confined within the tubes may be resilient and transparent, as when fabricated from plasticized polyvinylchloride, or may be opaque and may contain pictorial indicia.

A pair of pivot pins 23 are disposed in diametrically opposed relationship in attachment to the outer periphery of outermost tube 17. Said pivot pins are adapted for insertive engagement with retainer means 24 affixed in diametrically opposed relationship to the interior surface of spherical enclosure 12. In said interactive engagement of said pivot pins with said retainer means, spherical enclosure 12 functions as a support means permitting assembly 10 to rotate about a horizontal axis defined by pivot pins 23.

Spherical enclosure 12, fabricated of transparent material, is supported from beneath by vertical cylindrical sleeve 25 coaxially affixed atop wheel-shaped pedestal 26 rotatively associated with bottom panel 27 of base 13. The common axis of sleeve 25 and pedestal 26, when upwardly extended, constitutes the vertical axis of rotation of spherical enclosure 12 and assembly 10.

An electric light bulb 28 is positioned within electric receptacle 29 fixedly mounted by screws 32 to bottom panel 27 below pedestal 26 and centered on said vertical axis. The cylindrical neck 30 of said receptacle is adapted to make close-fitting contact with interior cylindrical wall 31 of pedestal 26, thereby positioning said pedestal for horizontal rotative motion about said vertical axis.

An electric motor 58 is anchored to bottom panel 27 of base 13. A drive axle 33 emerging upwardly from said motor is equipped with horizontally disposed power transmitting gear 34 which engages power receiving gear 35 on the upper portion of vertical shaft 36 rotatively journalled to bottom panel 27 and upper panel 37 of base 13. Keyed to a lower portion of shaft 36 is a first drive means in the form of horizontally disposed gear 38 which engages the horizontally disposed circular track 39 on pedestal 26, said track 39 having a toothed configuration. Motor 58 in association with gears 34 and 35 and shaft 36 constitutes energizing means which causes rotation of pedestal 26.

A horizontally disposed ring of beveled teeth 40 disposed on pedestal 26 above horizontal track 39 and in fixed coaxial relationship therewith engages first vertically disposed bevel gear 41 rotatively journalled to cylindrical sleeve 25. The uppermost extremity of first bevel gear 41 engages the lowermost extremity of mating second vertically disposed bevel gear 42 keyed to axle 43 which extends transversely across sleeve 25 in journalled engagement therewith.

Figure 4:
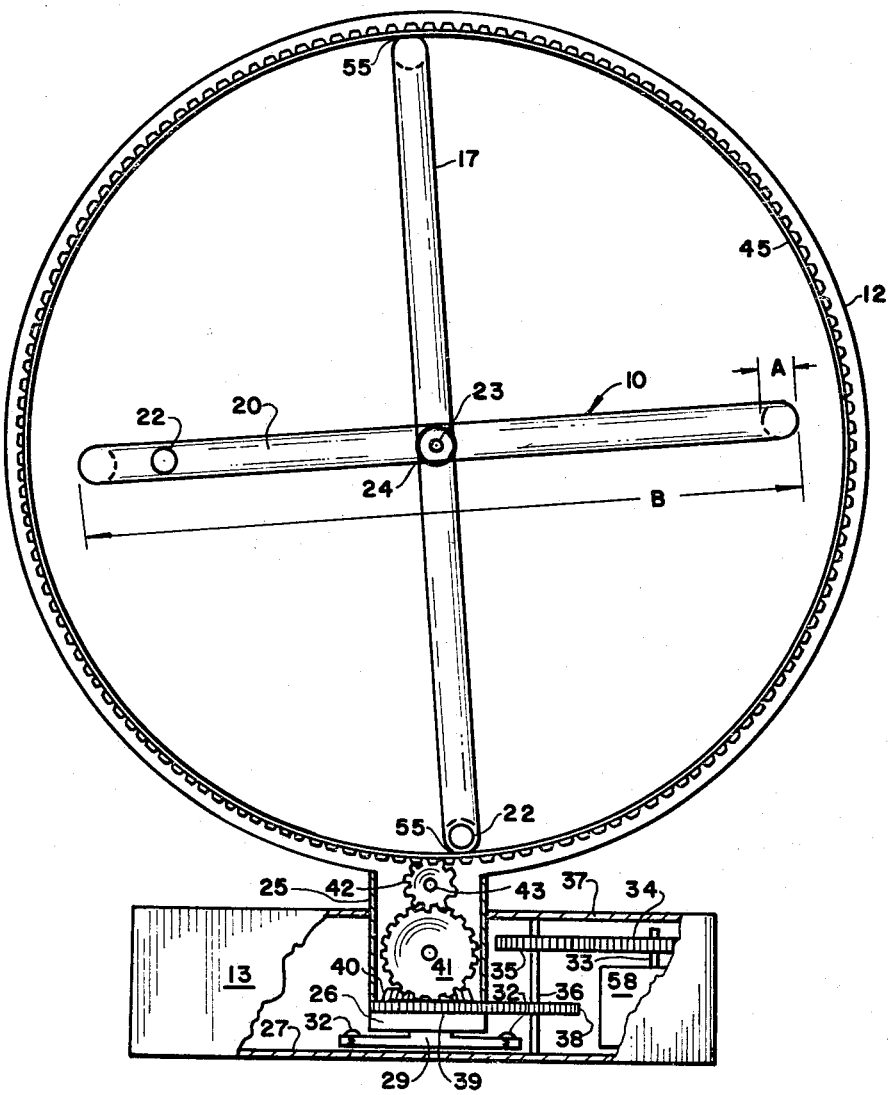
FIG. 4 is a side view of the device of FIG. 1 with parts broken away to reveal details of internal structure.

A second drive means in the form of toothed gear 44 is keyed to the center of axle 43 and is adapted to rotatively engage vertically disposed circular track 45 in the form of a toothed ring attached to outermost tube 17 at diametrically opposed sites 55 shown in FIG. 4 centered within said plane of symmetry.

The motion coupling means of the exemplified embodiment of the device is comprised of: (a) first drive means 38, (b) horizontally disposed circular track 39, (c) bevelled toothed ring 40, (d) first vertically disposed bevel gear 41, (e) second vertically disposed bevel gear 42, (f) second drive menas 44, and (g) vertically disposed circular track 45. By virtue of said coupling means, motion imparted to first drive means 38 by the aforementioned energizing means causes rotation of support means such as spherical enclosure 12 about a vertical axis, and rotation of said assembly about a horizontal axis during its rotation on said support means about said vertical axis. The circular track 45 is substantially driven by torque transmitted by bevel gears from the rotary motion of pedestal 26 and associated support means 12.

Figure 5:
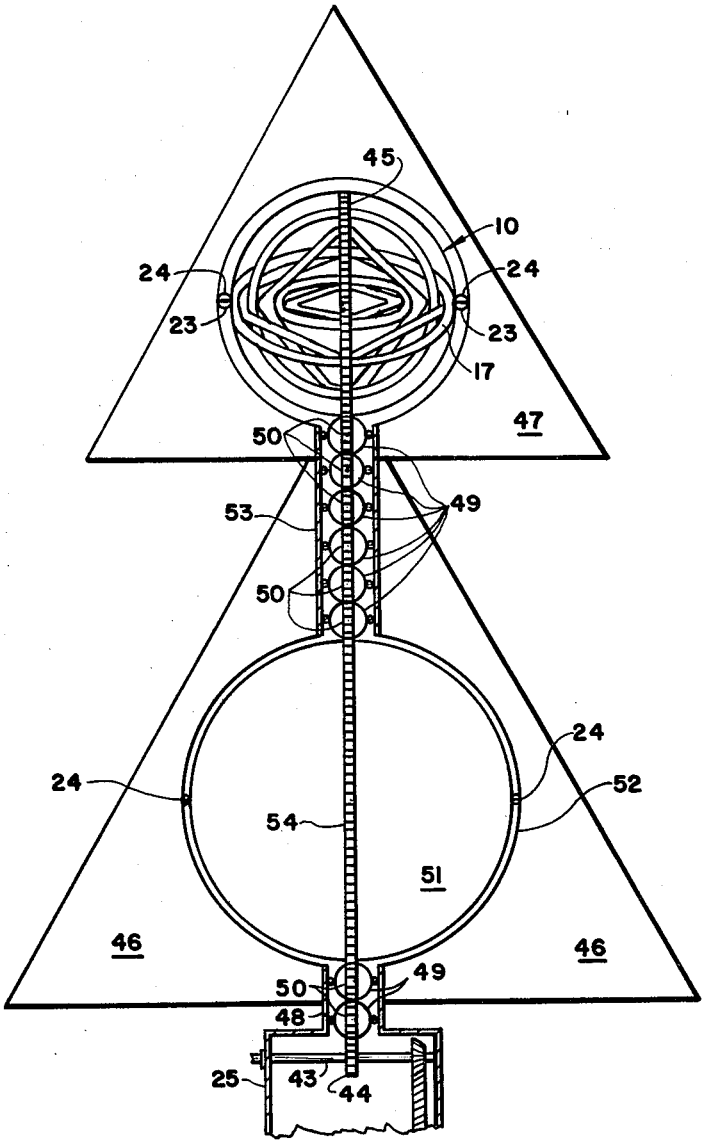
FIG. 5 is a partial front view of another embodiment of the device of this invention.

Referring to FIG. 5, an embodiment of the device of this invention is shown having lower large angular panels 46 and upper small angular panel 47, said panels being interconnected in coplanar disposition and symmetrically disposed about a vertical axis of rotation. Lower panels 46 are joined to lower extension tube 48 which in turn is fixedly attached to cylindrical sleeve 25 having the same function as the corresponding sleeve 25 of the embodiment of FIG. 1. Small coupling balls 49 provided with vertically encircling toothed tracks 50 are journalled to the walls of extension tube 48 for rotative motion therein about horizontal axes. Similarly, large coupling ball 51 having toothed track 54 is positioned within a central aperture 52 defined by panels 46 and is journalled to said panels for rotative motion therein about a horizontal axis. Upper extension tube 53 joined to panels 46 and 47 likewise contains small coupling balls 49 provided with toothed tracks 50. An assembly 10 comprised of interconnected hollow tubes is mounted for rotative motion about a horizontal axis by paired pivot pins 23 associated with outermost tube 17 and which engage retainer means 24 held by panel 47.

Rotative motion is transmitted from second drive gear 44 through interengaged toothed tracks 50 and 54 to vertically disposed circular track 45 around assembly 10. In this manner, large and small coupling balls 51 and 49 respectively, become part of the motion coupling means causing assembly 10 to rotate about the horizontal axis defined by pivot pins 23. Since panels 46 and 47 concertively serve as support means in a manner analogous to the function of spherical enclosure 12 of the embodiment of FIG. 1, and since said support means is rotated about its vertical axis, components of the device above base 13 are caused to rotate about a vertical axis while assembly 10 and coupling balls 49 and 51 simultaneously rotate about horizontal axes. By appropriate placement of suitably shaped panels, the device of FIG. 5 may be found illustratively suggestive of a Christmas tree.

The upper panel 37 of base 13 is fabricated preferably of a light-transmitting material. Means may be provided for cyclically modifying the nature of light emitted from light bulb 28. Such means may include for example, rotating optical filters, diffraction gratings, lenses, shutters or the like interposed between the light bulb and assembly 10, stroboscopic electronic means for varying light intensity, and other known expedients.

The motor and light bulb may be activated by alernating current of 110 volts or other voltages or by direct current as may be provided by battery 56 in base 13. A double pole double throw switch 57 associated with base 13 may be employed to control on-off operation of the device. A timing mechanism may also be utilized for automatic on-off control of switch 57 or equivalent means.

Although the support means has been exemplified in the forms of spherical enclosure 12 and angular panels 46 and 47, other configurations are contemplated within the purview of this invention. Suitable support means may be generically characterized as symmetrical structures capable of supporting two diametrically opposed pivot means for horizontal rotation, and communicating with base 13 in a manner to be rotated about a vertical axis.

The pivot means associated with outermost tube 17 may penetrate the support means and supportively hold another assembly of tubes adapted to rotate about the same horizontal and vertical axes.

The motion coupling means may have specific forms other than those disclosed herein. The circular tracks and associated drive means may be gear-like toothed wheels or wheels having friction engagement surfaces producing equivalent effects, or pulley-type wheels having a continuous peripheral groove which confines a pulley belt interactive between the circular tracks and associated drive means.

Although the base has been exemplified as being positioned beneath said assembly, it is apparent that with suitable obvious structural additions, the base may be located above or at horizontally even level with said assembly. The base, which may instead be referred to as a housing means which confines motivational and lighting components, should however be substantially centered within the plane of symmetry of the device containing an axis of rotation. When the housing means is positioned at a horizontally even level with said assembly, the aforesaid vertical and horizontal axes of rotation are interchanged. Therefore, to more clearly define the axes of rotation of said assembly, it may be said that one axis of rotation, a first axis, is perpendicular to the plane of symmetry, and the other axis of rotation, a second axis, is within said plane of symmetry and perpendicular to said first axis. When the housing means is positioned above said assembly, the device may be used as a ceiling-suspended ornamental lighting fixture.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

I claim:

1. A display device comprising:

a. a rigid assembly of toroidally shaped hollow tubes which confine balls adapted for continuous travel within said tubes, said assembly having a plane of symmetry perpendicular to said tubes, b. a pair of pivot means associated in diametric opposition with the outermost tube of said assembly and adapted to permit rotation of said assembly about a first axis perpendicular to said plane of symmetry, c. housing means substantially centered within said plane of symmetry, d. support means associated with said housing means in a manner permitting rotation of said support means about a second axis within said plane of symmetry and perpendicular to said first axis, said support means engaging said pivot means.

e. energizing means disposed within said housing means, f. motion coupling means which, when activated by said energizing means, rotate said assembly about said first and second axes simultaneously, and g. a light source associated with said housing means and adapted to illuminate said tubes substantially uniformly with respect to said second axis.

2. The display device of claim 1 wherein said assembly is comprised of a first series of concentrically arranged tubes and a second series of concentrically arranged tubes interspersed in alternating manner between tubes of said first series and perpendicular thereto, all tubes being interconnected to form a rigid assembly.

3. The display device of claim 1 wherein said housing means are disposed below said assembly and said second axis is vertically oriented.

4. The display device of claim 1 wherein said tubes are interconnected at sites which lie along said first axis.

5. The display device of claim 1 wherein said tubes are substantially transparent.

6. The display device of claim 1 wherein said support means is a substantially transparent spherical structure.

7. The display device of claim 1 wherein said light source is an electric light bulb fixedly centered on said second axis.

8. The display of claim 1 wherein said energizing means is comprised of an electric motor and associated shafts and interengaging geared wheels which cause rotative motion of said support means about said second axis.

9. The display device of claim 1 wherein said motion coupling means comprise bevel gears driven by the rotative motion of said support means, and a gear which encircles said assembly and is driven by torque transmitted by said bevel gears.

* * * * *